United States Patent [19]

Sweeney et al.

[11] Patent Number: 4,688,363

[45] Date of Patent: Aug. 25, 1987

[54] LOCKING WEDGE SYSTEM

[76] Inventors: Patrick Sweeney, 4 Chadbury Place, Toronto, Ontario, Canada, M1W 2V8; Frank Camisso, 31 Bucks Green Road, Thornhill, Ontario, Canada, L3T 4G1; Scott Burns, 29 Bryant Road, Markham, Ontario, Canada, L3P 5C4

[21] Appl. No.: 916,141

[22] Filed: Oct. 7, 1986

[51] Int. Cl.[4] ..... E04B 2/30; E04B 1/76

[52] U.S. Cl. ..... 52/407; 52/562

[58] Field of Search ..... 52/407, 562, 410, 712, 52/713, 378; 144/193 D, 193 E, 193 J; 256/56; 238/324, 353; D8/47; 411/538

[56] References Cited

U.S. PATENT DOCUMENTS

| | | | |
|---|---|---|---|
| D. 33,919 | 1/1901 | Waite | D8/47 |
| D. 238,745 | 2/1976 | Bedard | D8/47 |
| 632,787 | 9/1899 | Metcalf | 256/56 |
| 905,069 | 11/1908 | Hair | 144/193 D |
| 1,380,559 | 6/1921 | Jespersen | 144/193 E |
| 1,435,731 | 11/1922 | Peters | 238/324 |
| 3,772,840 | 11/1973 | Hala | 52/407 |
| 4,545,163 | 11/1985 | Asselin | 52/562 |

FOREIGN PATENT DOCUMENTS

| | | | |
|---|---|---|---|
| 154043 | 9/1985 | European Pat. Off. | 52/410 |
| 633270 | 7/1936 | Fed. Rep. of Germany | 44/193 D |
| 2747068 | 4/1979 | Fed. Rep. of Germany | 44/193 D |
| 7607854 | 1/1978 | Netherlands | 52/410 |

*Primary Examiner*—John E. Murtagh

*Attorney, Agent, or Firm*—Arne I. Fors; Robert F. Delbridge

[57] ABSTRACT

A locking wedge interposed between insulating material and masonry spaced from a wall structure for biasing the insulating material against the wall structure, said locking wedge having a generally U-shaped body with a pair of spaced-apart arms joined at one end by a web, said arms defining therebetween a tapered slot increasing in width towards the distal ends of the arms, said body being uniformly tapered in thickness at the said distal ends of the arms, and a plurality of equispaced transverse notches forming a serriform pattern on one face of the body substantially along the length of the arms for receiving a longitudinal rod in said notches.

1 Claim, 8 Drawing Figures

LOCKING WEDGE SYSTEM

BACKGROUND OF THE INVENTION

This invention relates to a wall-tie reinforcing system and, more particularly, relate to a locking wedge for use in a wall-tie reinforcing system for securing and biasing planar insulating material against a wall structure.

Wall-ties for securing brick, block or tile or the like masonry veneer a spaced distance from a wall structure of a building are well known. U.S. Pat. Nos. 1,936,223 and 3,964,226, for example, disclose well known wall-ties which are adjustable vertically for imbedment in mortar between courses of the masonry veneer to interconnect the masonry veneer to an underlying wall structure.

Sheets of insulating material often are interposed between the veneer and wall structure, it being desired that the insulating material continuously abut the underlying wall structure to provide optimum insulation to the building, particularly winter and summer. The locking wedge of the present invention, in combination with conventional wire wall-ties provides adjustable means for biasing sheets of insulating material against an underlying wall structure.

STATEMENT OF INVENTION

In its broad aspect, the present invention has particular utility in combination with a plurality of wall-ties used for securing a brick, block or tile masonry veneer a spaced distance from a wall structure, in biasing a planar insulating material disposed between said wall structure and said veneer against the wall structure. The improvement characterized by the present invention comprises a locking wedge supported by a longitudinal rod secured to the wall-ties and interposed between the insulating material and the veneer for securing and biasing the insulating material against the wall structure, said locking wedge having a generally U-shaped body with a pair of spaced apart arms joined at one end by a web, said arms defining therebetween a tapered slot increasing in width towards the distal ends of the arms, said body being uniformly tapered in thickness from a maximum thickness at the web to a minimum thickness at the said distal ends of the arms, and a plurality of equispaced transverse notches forming a serriform pattern on one face of the body substantially along the length of the arms.

The invention will now be described with reference to the accompanying drawings, in which:

FIG. 1 perspective view of the wedge of the present invention;

FIG. 2 is a top plan view of the said wedge;

FIG. 3 a bottom plan view thereof;

DESCRIPTION OF THE PREFERRED EMBODIMENT

Figure 1:
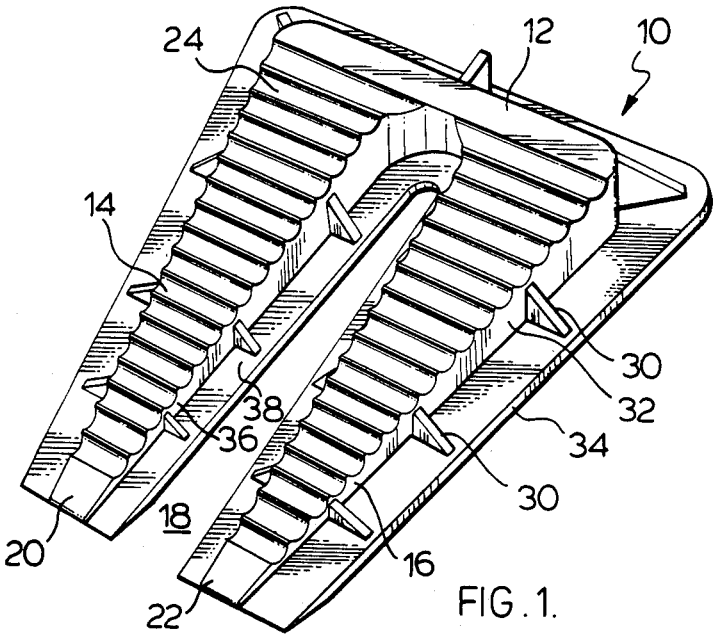
Figure 2:
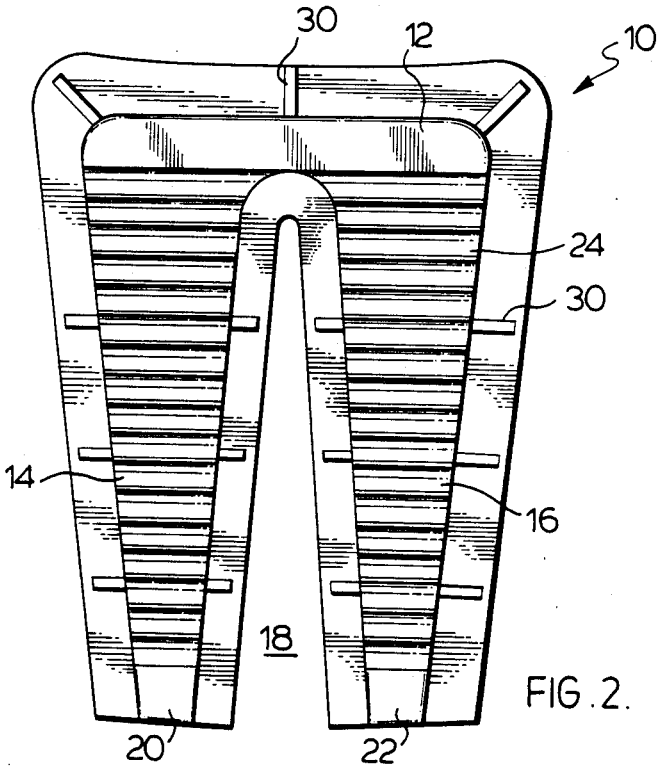
Figure 3:
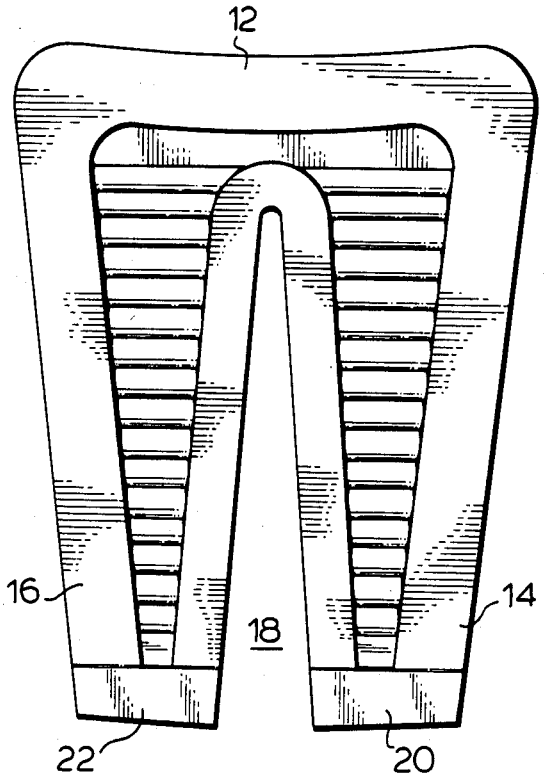
Figure 4:
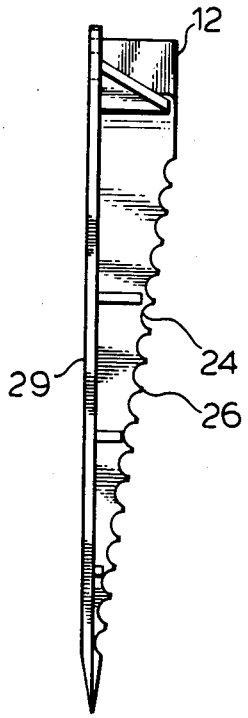
FIG. 4 is a side elevation thereof.
Figure 5:
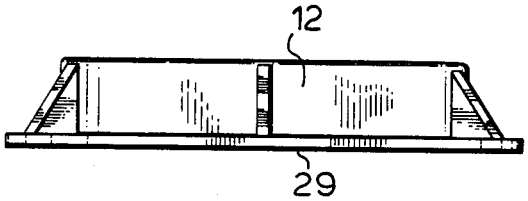
FIG. 5 is a top end elevation.
Figure 6:
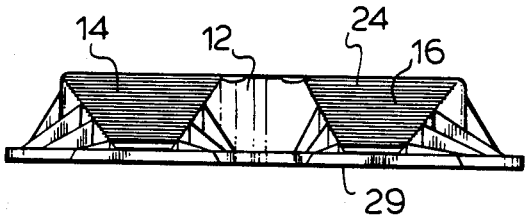
FIG. 6 is a bottom end elevation.

With reference first to FIGS. 1-6, the locking wedge 10 of the invention preferably is formed by injection moulding of a substantially rigid plastics material such as polyvinylchloride or can be stamp formed from a metal such as sheet aluminum or steel. Wedge 10 comprises a web 12 with space apart arms 14, 16 extending therefrom defining a tapered recess 18 increasing in width outwardly from web 12 to distal ends 20, 22 of arms 14, 16.

The body of the wedge is uniformly tapered in thickness from a maximum thickness at web 12 to a minimum thickness at the distal ends 20, 22 of the arms for reasons which will become apparent as the description proceeds. One face 24 of the wedge body has a plurality of equispaced transverse notches 26 formed thereon providing a serriform pattern substantially along the length of the arms 14, 16, shown most clearly in FIGS. 3-6. It will be seen that face 29 is planar with opposite face 24, having transverse notches 26 formed thereon, inclined at an included angle of about 5°-12° to the plane of face 29 to provide the uniform taper. Wedge 10 as shown in the drawings may be formed of a plastics material by injection moulding and accordingly may be thin-walled with the presence of a plurality of spaced gussets 30 formed between the side wall 32 and continuous flange 34 extending about the outer periphery of the wedge and inner side wall 36 and flange 38 defining slot 18.

Figure 7:
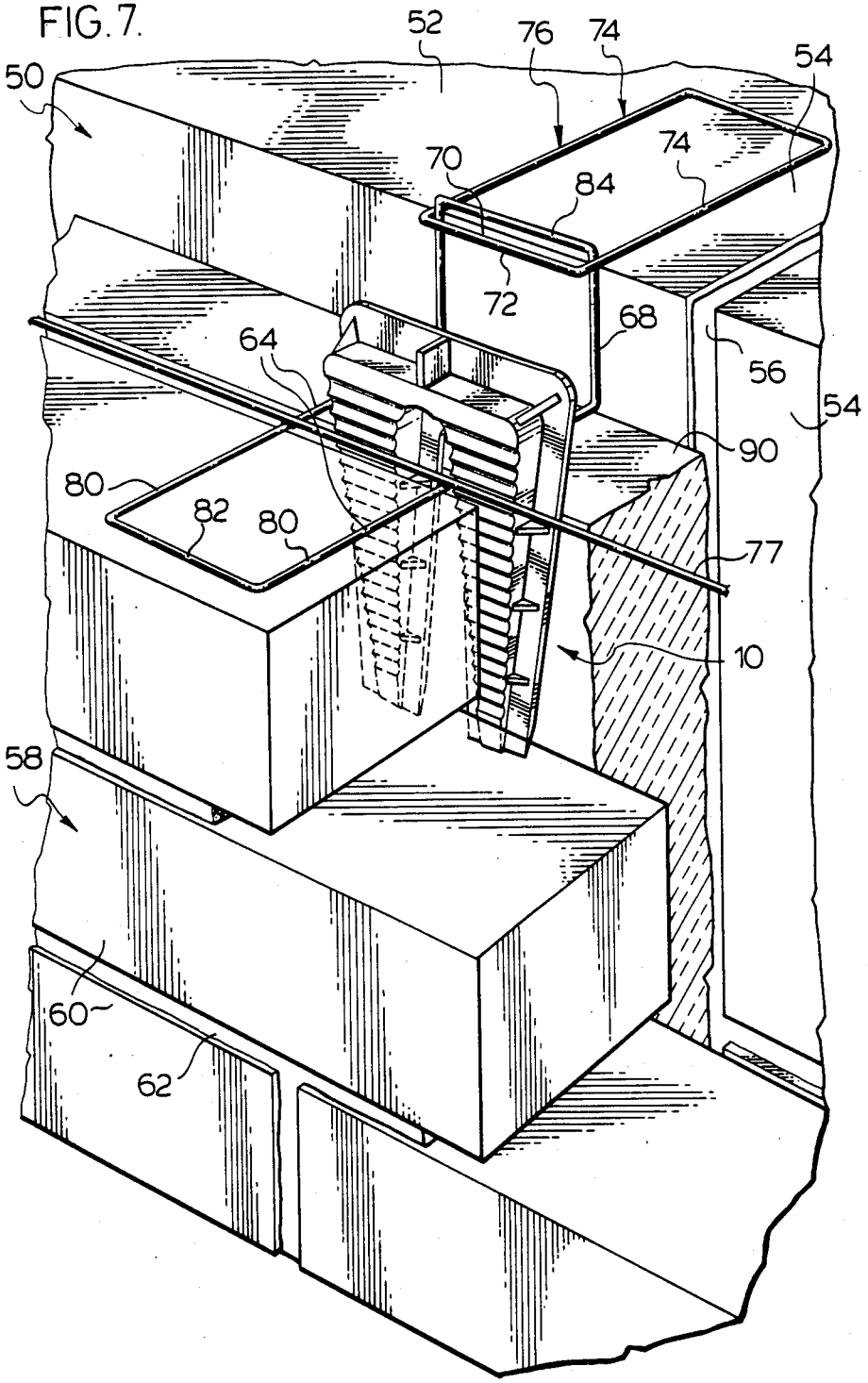
FIG. 7 is a perspective view of the said wedge in combination with a wall-tie in its operative position.
Figure 8:
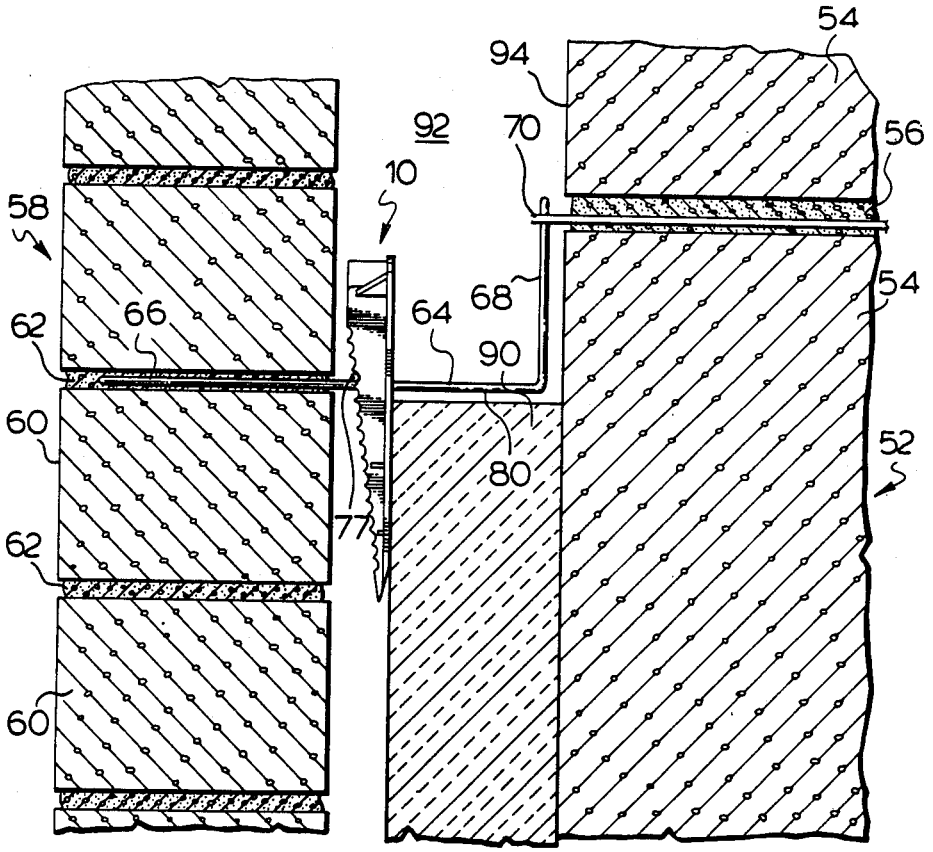
FIG. 8 a side elevation of the said wedge in its operative position.

With reference now to FIGS. 7 and 8, wedge 10 is shown in combination with a wall system 50 in which underlying wall 52 formed of concrete blocks 54 with mortar joints 56 has a brick veneer 58 spaced therefrom. Brick veneer 58 comprises a plurality of bricks 60 with mortar joints 62. A plurality of randomly spaced tie rods 64, one of which is shown, extend outwardly from wall 52 to be seated on a tier of bricks 60 for imbedment in mortar layer 62, shown most clearly in FIG. 8, at its distal end 66. In the embodiment of tie rod system shown in FIGS. 7 and 8, tie rod 64 has an inner end 68 bent perpendicular to the distal end 66 for insertion into the bight 70 formed by web 72 joining side members 74 of tie rod component 76 seated within the mortar 56 between concrete blocks 54 of the interior wall 52 for vertical adjustment of tie rod 64.

It will be understood that tie rod 64 and its inner component 76 are typical only of tie rod assemblies commonly used in connecting masonry veneers to interior walls. In the embodiment of tie rod system illustrated, tie rod 64 comprises a pair of outwardly extending side arms or ties 80 joined by a web 82 at their distal ends and by a web 84 at their inner ends to maintain the side arms 80 a parallel, spaced distance apart and to maintain inner end 68 either upturned or downturned as expedient for engagement by inner tie rod component 76. A horizontal rod 77 secured to side arms 80, or to transverse reinforcing ties, not shown, extends longitudinally horizontally a spaced distance from the face 94 of inner wall 52.

Planar heat insulating sheet 90, such as cellular polystyrene of desired thickness, is positioned within the cavity 92 between the underlying wall 52 and brick veneer 58 and biased against the outer surface 94 of inner wall 52 by a plurality of wedges 10, one of which is shown straddling a tie 80 and engaging rod 77 between notches 26 on inclined face. Wedge 10 can thus be inserted downwardly to bias sheet 90 against inner wall surface 94.

It will be understood, of course, that modifications can be made in the embodiment of the invention illustrated and described herein without departing from the scope and purview of the invention as defined by the appended claims.

We claim:

1. A locking wedge system for use with a wall structure for securing a masonry veneer a spaced distance from the wall structure and for biasing a planar insulating material disposed between said masonry veneer and said wall structure against the wall structure, comprising a plurality of transverse wall ties and a longitudinal rod secured to said wall ties, a locking wedge interposed between the insulating material and the masonry veneer, said locking wedge having a generally U-shaped body with a pair of spaced-apart arms joined at one end by a web, said arms defining therebetween a tapered slot increasing in width towards the distal ends of the arms for straddling a transverse wall tie, and said body being uniformly tapered in thickness from a maximum thickness at the web to a minimum thickness at the said distal ends of the arms having a plurality of equispaced transverse notches forming a serriform pattern on one face of the body substantially along the length of the arms for receiving a longitudinal rod in said notches.

* * * * *